United States Patent [19]

Duerr

[11] 4,077,516

[45] Mar. 7, 1978

[54] SHRINK WRAP PACKAGE WITH TEAR STRIP

[75] Inventor: Joseph W. Duerr, Rockleigh, N.J.

[73] Assignee: Ganz Brothers, Inc., Bergenfield, N.J.

[21] Appl. No.: 687,091

[22] Filed: May 17, 1976

[51] Int. Cl.[2] ..... B65D 65/26

[52] U.S. Cl. ..... 206/602; 206/432; 206/497; 206/605

[58] Field of Search ..... 229/51 D, 51 DB; 206/497, 498, 432

[56] References Cited

U.S. PATENT DOCUMENTS

| | | | |
|---|---|---|---|
| 2,689,643 | 9/1954 | Willits | 229/51 D |
| 3,231,083 | 1/1966 | Rumsey, Jr. | 206/497 |
| 3,343,746 | 9/1967 | Shiffman | 229/51 DB |
| 3,825,113 | 7/1974 | Kramer et al. | 206/497 |
| 3,906,702 | 9/1975 | Yand | 206/497 |

FOREIGN PATENT DOCUMENTS

| | | | |
|---|---|---|---|
| 2,449,633 | 9/1974 | Germany | 206/497 |

*Primary Examiner*—William Price
*Assistant Examiner*—Douglas B. Farrow
*Attorney, Agent, or Firm*—Diller, Brown, Ramik & Wight

[57] ABSTRACT

Packages are now being formed by applying plastic materials of the type which shrink upon being heated to form a casing or wrapper in which a plurality of containers are encased for ease in handling. The plastics material is very thin and in the form of a film and the usual articles packaged therein are containers, most particularly cans. A limited number of articles is presently being incorporated in such packages. It is proposed to join together at least two of such packages to form a further and larger package utilizing strips which will bond to the plastics material of the casings and wherein at least one strip is provided with an extension in the form of a pull tab and wherein when the one strip is pulled relative to the package, it will result in the tearing of portions of the casings so as to open the individual packages and make the articles therein readily available for use.

7 Claims, 7 Drawing Figures

FIG.3
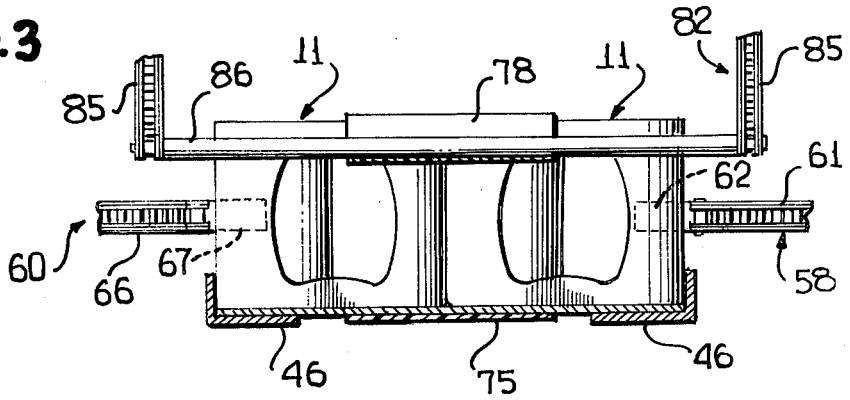
FIG.7
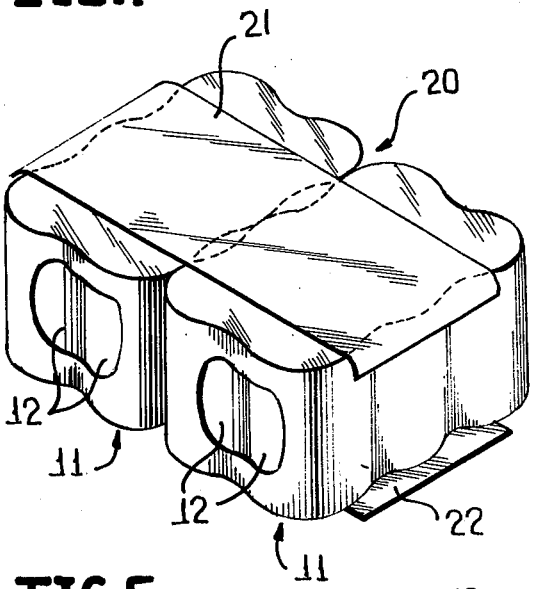
FIG.4
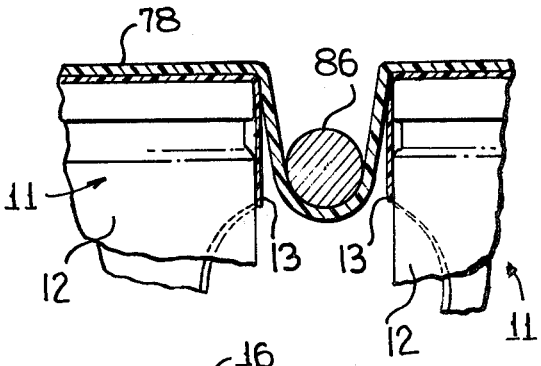
FIG.5
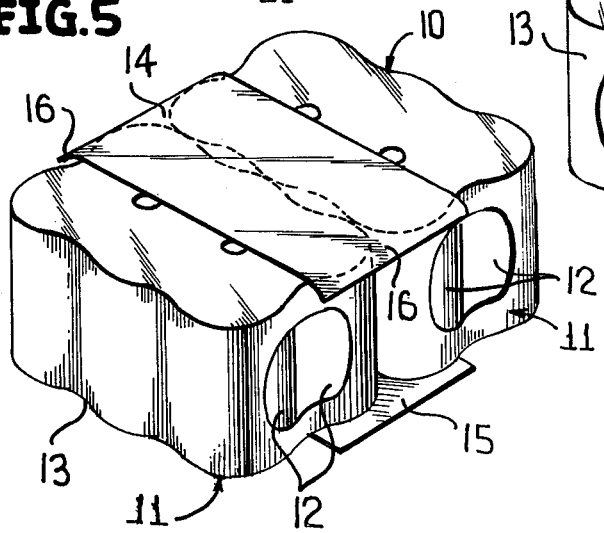
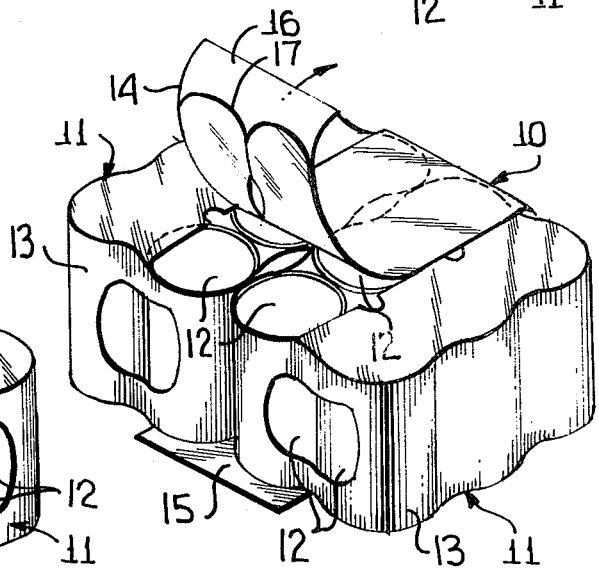
FIG.6

SHRINK WRAP PACKAGE WITH TEAR STRIP

This invention relates in general to new and useful improvements in packages and more particularly to packages of the shrink wrap type.

At the present numerous articles are packaged in shrink wrap wrappers or casings. Such present packages contain readily useable quantities of the packaged articles. However, the packages must then be packed in suitable shipping cases. In certain instances articles are merchandised in double packages or case lots. Most particularly, beer and soft drinks are packaged in six packs and twelve packs but frequently sold by the case. This requires a further packaging member, normally in the form of a cardboard carton which is relatively expensive.

The most conventional package of containers is a six pack which includes two rows of three containers each. A machine especially constructed to form the six packs cannot be utilized for the purpose of forming twelve packs. In accordance with this invention, it is proposed to join together two six packs in side-by-side relation by applying to the bottom and tops of such six packs elongated strips or straps of plastics material which may be readily bonded to the casings or wrappers of the six packs. Further, by forming the strips of plastics material of a greater strength than the material of the casings, when the strips are torn from the combined package, the casings will be automatically torn so that an opening of the packages is readily effected.

For the purpose of disclosing the invention, the descriptive matter herein will be restricted to the formation of six packs into twelve packs. It is to be understood, however, that a twelve pack, that is a package containing twelve articles arranged in two rows of six articles each, may be joined together by strips so as to form a package containing twenty four articles which is, in the case of beer and beverage containers, a case.

With the above and other objects in view that will hereinafter appear, the nature of the invention will be more clearly understood by reference to the following detailed description, the appended claims and the several views illustrated in the accompanying drawings:

IN THE DRAWINGS

FIG. 3 is a transverse vertical sectional view taken along the line 3—3 of FIG. 1.

FIG. 4 is an enlarged fragmentary longitudinal sectional view taken through a pair of adjacent groups of containers generally in the area designated by the reference FIG. 4 in FIG. 1.

FIG. 5 is a perspective view of a twelve pack formed in accordance with this invention.

FIG. 6 is a rotated perspective view of the twelve pack of FIG. 5 in the process of being opened.

FIG. 7 is a perspective view of another form of twelve pack formed in accordance with this invention.

Figure 1:
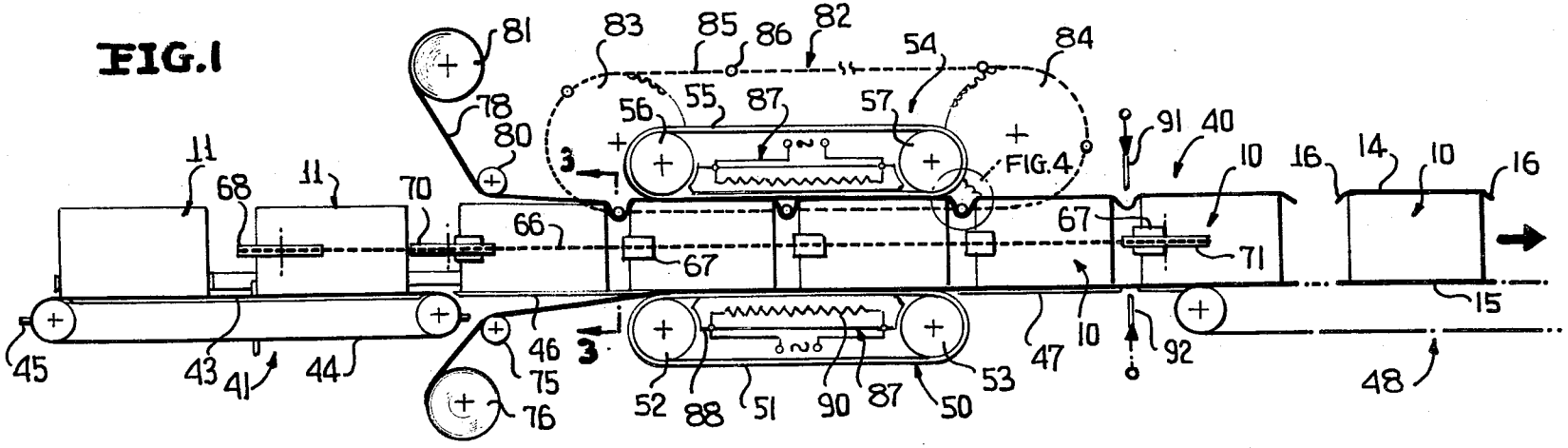
FIG. 1 is a side elevational view of apparatus for joining together two six packs to form a twelve pack in accordance with this invention.

Referring now to the drawings in detail, reference is first made to FIGS. 5 and 6 wherein packages formed in accordance with this invention are illustrated. The article packages are generally identified by the numeral 10 and each article package 10 includes a pair of packages 11. Each illustrated package 11 is a conventional package which includes six containers 12 arranged in two rows of three containers each encased within a casing or wrapper 13 which is formed of a film of plastics material, which plastics material when subjected to heat shrinks so as to tightly encase the articles 12 therein. Inasmuch as the packages 11 are of known construction, no further description thereof is necessary here.

In accordance with this invention, two of the packages 11 are placed in side by side relation. The packages 11 are then joined together by means of an upper strip 14 and a lower strip 15 which are preferably formed of plastics materials which are heat bondable to the plastics material of the casings 11. At least the upper strip 14 will be provided with extensions in the form of pull flaps 16 at the opposite ends thereof to facilitate the gripping of the upper strip 14 and the tearing thereof from the package 10. Further, the upper strip 14 will be of a greater strength than the material of the casings 13 so that rupture of the casings 13 as opposed to rupture of the strip 14 will be assured.

Reference is now made to FIG. 6 wherein the package 10 is illustrated as being partially opened. It is to be noted that there is a particularly strong bond between the strip 14 and the casing 13 about the peripheries of the containers 12. As is well known, cans have upstanding chimes and when the strips 14 and 15 are brought into pressure contact with the packages 11 under the influence of a heating atmosphere, where the casings 13 are backed up by the chimes or double seams of the cans, there will be a particularly good bonding of the strips 14 and 15 to the casings 13. Thus, when the strip 14 is torn from the casings 13, those portions of the casings 13 defined by the particularly good heat seals, designated by the reference numeral 17 in FIG. 6, will be torn from the remainder of the casings 13 so as to expose the containers 12 therein.

As is clearly shown in FIGS. 5 and 6, the strips 14 and 15 extend parallel to the rows of the containers 12 in the packages 11 and extend over the two center rows of the resultant package 10. Thus, the two central rows of the cans 12 are exposed in the opening of the package 10, as is shown in FIG. 6.

Reference is now made to FIG. 7 wherein a slightly modified form of package is illustrated. This package is generally identified by the numeral 20 and, like the package 10, is formed of two packages 11 joined together by strips 21 and 22 which correspond to the strips 14 and 15, respectively, of the package 10. The strips 21 and 22, however, extend transversely of the rows of the cans, instead of parallel thereto, as shown in FIG. 5, and thus primarily overlie the single center row of cans in the package 20. Other than the relative orientation of the strips 21,22 with respect to the rows of the containers within the packages 11, the package 20 is the same as the package 10 and functions in the same manner.

Reference is now made to FIGS. 1–4 wherein the apparatus for forming the packages is illustrated. The apparatus, which is generally identified by the numeral 40, includes a first conveyor section 41 which receives the packages 11 as at 42 from any suitable source, including a machine which forms such packages 11. The first conveyor section 41 includes support bars 43 which support the packages 11 and endless conveyor means 44 including driving lugs 45 for moving the packages 11 in groups of two onto a deadplate 46.

Spaced longitudinally of the deadplate 46 is an aperture deadplate 47 for receiving the packages 10. The individual packages 10 are transferred out of the machine 40 by means of a discharge conveyor unit 48.

Between the deadplates 46 and 47 is a lower conveyor unit 50 which includes an endless member 51 carried by a pair of rolls 52,53, one of which is driven. Overlying the path of movement of the packages 11 is another conveyor unit, generally identified by the numeral 54. The conveyor unit 54 includes an endless conveyor member 55 carried by a pair of rolls 56,57, one of which is driven. It is to be understood that the endless members 51 and 55 are to be formed of a heat conductive material, as will be described hereinafter.

In between the conveyors 41 and 48, movement of the packages 11 is effected by means of a pair of conveyors 58 and 60 disposed on opposite sides of the path of the movement of the groups of packages 11. The conveyor 58 includes an endless chain 61 having mounted thereon at spaced intervals lugs 62. The endless chain 61 is supported by sprockets 63,64 and 65, of which one is a drive sprocket, at an elevation approximately mid-height of the packages 11, as is best shown in FIG. 1.

The conveyor 60 also includes an endless chain 66 carrying lugs 67. Sprockets 68,70 and 71 support the chain 66 at the same elevation as the chain 61 and on the opposite side of the packages 11 therefrom.

Figure 2:
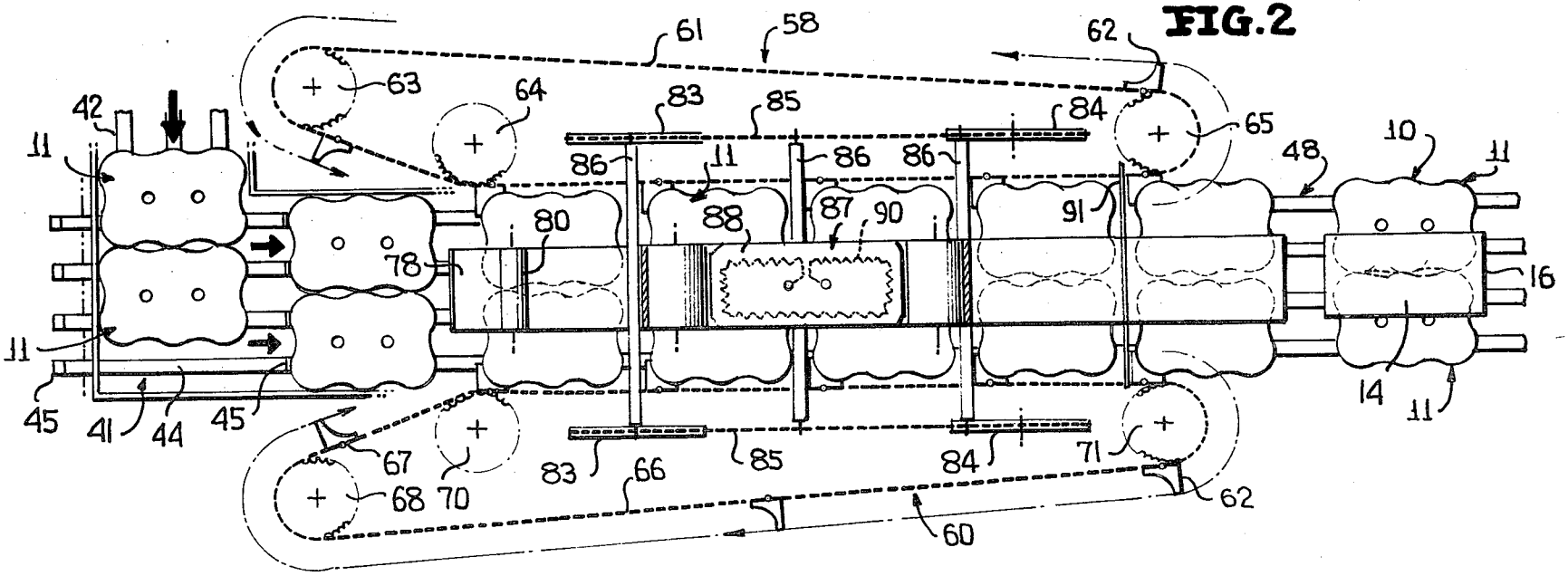
FIG. 2 is a top plan view of the apparatus of FIG. 1.

Packages 11 are urged into the machine 10 in the manner illustrated in FIG. 2 and are then moved forwardly in groups of twos by the conveyor 41. As the groups of packages 11 move onto the deadplate 46, they are engaged by the lugs 62,67 of the conveyors 58,60, respectively. The lugs 62, 67 then engage the two packages 11 of each group and move the same off the deadplate 46 onto the upper surface of the endless belt 51 in the manner generally shown in FIG. 1. However, interposed between the undersides of the packages 11 and the belt 51 is a strip 75 of plastics material which pass from a roll 76 thereof over a roller 77 into overlying relation with respect to the upper run of the conveyor belt 51.

The packages 11 riding on the conveyor belt 51 are compressively urged downwardly by a lower run of the upper conveyor belt 55. The packages 11, however, are separated from the conveyor belt 55 by means of a strip 78 of plastics material which is dispensed under a roller 80 from a roll 81 of the plastics material.

At this time it is pointed out that the packages of each group are separated from the packages of a next adjacent group. This spacing, while exaggerated in FIGS. 1 and 2, is preferably relatively small and on the order of ¼ inch. This leaves insufficient material to form the grip portions 16 of the strip 14 previously described. Accordingly, there is provided a strip depressor, generally identified by the numeral 82. The strip depressor 82 includes two sets of transversely spaced sprockets 83 and 84 which rotate in unison and have entrained thereover endless chains 85 which have extending therebetween rods 86. As is clearly shown in FIG. 1, the lower run of the rods 86 is at a level below the tops of the packages 11 and the rods 86 are positioned to enter into the space between the adjacent packages so as to draw the strip of plastics material 78 down in between the adjacent groups of packages and thus provide additional material. This will be described in more detail hereinafter.

At this time it is pointed out that the endless belts 51,55 are formed of a suitable heat transferrable material and may possibly be formed of stainless steel. Associated with the upper run of the belt 51 and the lower run of the belt 55 are heating units, generally identified by the numeral 87. Each heating unit 87 is intended to suitably heat that portion of the respective one of the endless belts 51,55 opposing the packages 11. Each heating unit 87 may be of several alternative constructions and may utilize hot air, if desired. However, in the illustrated from each heating unit 87 includes a shoe 88 which backs up the respective endless belt portion and which shoe 88 is provided with an electrical heating element 90 to effect the heating thereof to the necessary temperature.

It will be readily apparent that the strips 75 and 78 of plastics material are tightly clamped against the packages 11 as they pass between the belts 51 and 55. Since those portions of the belts 51,55 which engage the strips 75,78 are heated to a temperature sufficient to effect bonding of the strips 75,78 to the material of the casings 13, it will be seen that bonding of the strips 75,78 to the casings 13 is automatically effected. As described above with respect to FIG. 6, since the casings 13 are forced against the ends of the cans 12, there is a maximum bonding of the strips 75,78 to the casings 13 in alignment with the end portions of the containers 12.

After the strips 75,78 have been bonded to the casings of the packages 11, the packages 11 are now in the form of the packages 10, but are still joined together by the strips 75,78. As the packages 10 pass across the deadplate 47, vertically movable upper and lower knives 91,92 are reciprocated to effect the severing of the strips 75,78 between the adjacent packages 10. This separates the adjacent packages 10 as they leave the deadplate 47 and are picked up by the discharge conveyor 48.

As is best shown in FIG. 4, each of the rods 86 moves down between adjacent packages 11 and draws a portion of the strip 78 down into the space between the adjacent packages 11. It is to be noted that the draw down of the strip 78 is sufficient to provide the necessary grip portion 16 found on the strip 14.

It is to be understood that while the apparatus 40 is particularly constructed for forming the packages 10, the apparatus will automatically form the packages 20. Further, like apparatus will also be operable to form a twelve pack containing two rows of articles of six articles each into a twenty four pack or case package.

Although only a preferred embodiment of the invention has been specifically illustrated and described herein, it is to be understood that minor variations may be made in the apparatus, the method of forming the package and the package per se without departing from the spirit and scope of the invention, as defined by the appended claims.

What is claimed as new:

1. An article package comprising at least two packages each including a plurality of articles encased in a casing of plastics material, said packages being in aligned side-by-side relation, and strips of material each extending across said packages and being bonded to said casings, at least one of said strips having an extension forming grip means for removing said one strip from said article package together with portions of said casings to effect opening of said packages.

2. The article package of claim 1 wherein at least said one strip is of a greater strength than the material of said casings wherein when said one strip is torn from said packages said casings are opened to exposed articles therein.

3. The article package of claim 1 wherein at least said one strip is formed of plastics material and is of a greater thickness than the material of said casings wherein when said one strip is torn from said packages said casings are opened to exposed articles therein.

4. The article package of claim 3 wherein said strips are heat bonded to said casings.

5. The article package of claim 3 wherein said articles are containers having projecting ends, and said strips are heat bonded to said casings generally about the peripheries of ends of said containers.

6. The article package of claim 1 wherein each casing contains at least two rows of articles, and said strips extend parallel to said rows.

7. The article package of claim 1 wherein each casing contains at least two rows of articles, and said strips extend transversely of said rows.

* * * * *